US006829366B2

(12) United States Patent
Tanabe

(10) Patent No.: US 6,829,366 B2
(45) Date of Patent: Dec. 7, 2004

(54) MAGNETIC CIRCUIT AND LOUDSPEAKER USING THE SAME

(75) Inventor: Kei Tanabe, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 146 days.

(21) Appl. No.: 10/346,566

(22) Filed: Jan. 17, 2003

(65) Prior Publication Data

US 2003/0152246 A1 Aug. 14, 2003

(30) Foreign Application Priority Data

Jan. 21, 2002 (JP) ..... 2002-011741

(51) Int. Cl.[7] ..... H04R 25/00
(52) U.S. Cl. ..... 381/412; 381/397
(58) Field of Search ..... 381/412, 414, 381/420, 413, 422, 396, 397, FOR 159, FOR 161

(56) References Cited

U.S. PATENT DOCUMENTS 3,310,639 A * 3/1967 Collins ..... 381/420
3,803,522 A * 4/1974 Rooney ..... 335/231
4,017,694 A * 4/1977 King ..... 381/415
4,661,973 A * 4/1987 Takahashi ..... 379/194
4,783,824 A * 11/1988 Kobayashi ..... 381/402
4,980,921 A * 12/1990 Zwicky ..... 381/414
6,269,168 B1 * 7/2001 Tagami ..... 381/412
6,430,300 B1 * 8/2002 Cox et al. ..... 381/397
2001/0031063 A1 * 10/2001 Langford et al. ..... 381/397
2003/0133587 A1 * 7/2003 Hyre et al. ..... 381/412
2003/0152246 A1 * 8/2003 Tanabe ..... 381/412
2004/0086145 A1 * 5/2004 Stiles ..... 381/412

FOREIGN PATENT DOCUMENTS

JP 04-183200 6/1992
JP 08-140191 5/1996

* cited by examiner

*Primary Examiner*—Curtis Kuntz
*Assistant Examiner*—P. Dabney
(74) *Attorney, Agent, or Firm*—Brinks Hofer Gilson & Lione

(57) ABSTRACT

A magnetic circuit includes an annular magnet magnetized in the axial direction thereof; an annular stacked plate disposed on the magnet and including first and second annular plates; and a yoke facing the inner circumferential surface of the stacked plate across a cylindrical space. Upper and lower magnetic gaps are provided at two axially separated positions in the cylindrical space. A loudspeaker includes the magnetic circuit; a voice coil placed in the upper and lower magnetic gaps; a diaphragm connected to the voice coil; and a frame fixed to the stacked plate and supporting the diaphragm in a vibratable manner. The inner circumferential portions of the first and second annular plates are axially deformed downward and upward, respectively, such that the inner circumferential surface of the stacked plate faces the lower and upper magnetic gaps. The remaining portions of the first and second annular plates are stacked on the magnet.

18 Claims, 2 Drawing Sheets

MAGNETIC CIRCUIT AND LOUDSPEAKER USING THE SAME

BACKGROUND OF THE INVENTION

1. Field of the Invention

The present invention relates to magnetic circuits and electrodynamic loudspeakers using the same, and more particularly, the present invention relates to a loud speaker having a two-gap, one-voice-coil structure in which a diaphragm has a widened linear amplitude region by providing magnetic gaps at two positions in the axial direction of a magnetic circuit and disposing a voice coil in these magnetic gaps.

2. Description of the Related Art

In known electrodynamic loudspeakers in which a voice coil is placed in a magnetic gap provided halfway through the magnetic path of a magnet and a diaphragm is vibrated by feeding a signal current (voice current) to the voice coil, because sounds are distorted when the amplitudes of the voice coil and the diaphragm do not change linearly in accordance with the level of the signal current, it is required to maintain a constant magnetic flux, which acts on the vibrating voice coil, in the magnetic gap. However, as shown in FIG. 3, in a known electrodynamic loudspeaker, a pole piece 2 of a yoke 1 and an upper plate 3, forming the magnetic path of a magnet 4 magnetized in its axial direction, are opposed to each other via a magnetic gap G; a voice coil 5 having a winding width, i.e., a height, smaller than the width of the inner circumferential surface of the upper plate 3, is disposed in the magnetic gap G; and when the voice coil 5 is displaced upward or downward in the figure partially outside the magnetic gap G, the magnetic flux acting on the voice coil 5 sharply decreases. Therefore, the amplitude region of the voice coil 5 must be set small so as to suppress sound distortion. That is, the known electrodynamic loudspeaker has a problem in that turning the volume high causes sound distortion. Although it is possible to widen the linear amplitude region by making the winding width of the voice coil 5 greater than the width of the inner circumferential surface of the upper plate 3, the voice coil 5 becomes heavier in this case, resulting in a lowered electroacoustic transducing efficiency.

To solve the foregoing problems, as shown in FIG. 4, another known electrodynamic loudspeaker has been proposed in which a lower magnetic gap G1 and an upper magnetic gap G2 are provided at two separate positions in the axial direction (in the vertical direction in the figure), and the voice coil 5 is disposed in these magnetic gaps G1 and G2. A magnetic circuit of the known loudspeaker shown in FIG. 4 is characterized by the shape of the upper plate 3 placed on the magnet 4. More particularly, since the upper plate 3 has an annular indented groove 3*a* formed on the inner circumferential surface thereof which opposes the pole piece 2 of the yoke 1, the lower and upper magnetic gaps G1 and G2 are respectively formed below and above the indented groove 3*a* and between the upper plate 3 and the pole piece 2. Since the annular magnet 4 is magnetized in its axial direction so as to have an N-pole on its upper surface and an S-pole on its lower surface, the magnetic flux of the magnet 4 supplied to the upper plate 3 passes through the lower magnetic gap G1 and the upper magnetic gap G2 toward the pole piece 2, and then the magnetic flux flowing down in the pole piece 2 returns to the magnet 4 through a bottom plate 6 of the yoke 1. The voice coil 5, wound around a cylindrical bobbin 7, is vertically placed so as to partially oppose the upper portion of the lower magnetic gap G1 and the lower portion of the upper magnetic gap G2 when no current is fed. The top of the bobbin 7 in the figure is bonded to the inner circumference of a conical diaphragm 8 made from cone paper or the like. Also, the upper plate 3 has a frame 10 fixed thereon with screws 9, and the frame 10 supports the outer circumference of the diaphragm 8 through an elastic edge 11 and also supports the bobbin 7 through a damper 12 in a vibratable manner.

In the known loudspeaker having the above-described structure, even when the voice coil 5 is displaced so as to oppose the lower portion of the lower magnetic gap G1 or the upper portion of the upper magnetic gap G2 when a current is being fed, since the magnetic flux of the magnetic circuit, acting on the voice coil 5, can be maintained substantially constant, the linear amplitude region of the diaphragm 8 can be widened without making the voice coil 5 heavier in an unwanted manner, whereby the features of the loudspeaker can be improved. Such a conventional loudspeaker is disclosed in Japanese Unexamined Patent Application Publication No. 4-183200, for example.

Although the loudspeaker including the magnetic circuit shown in FIG. 4 more effectively widens the linear amplitude region of the diaphragm 8 than the loudspeaker including the magnetic circuit shown in FIG. 3, the former requires a very complicated cutting process for forming the annular indented groove 3*a* on the inner circumference of the upper plate 3, thereby leading to an increased manufacturing cost and machining precision. Also, even in the small-type loudspeaker, because the required lengths, i.e., depths, of the magnetic gaps G1 and G2 and the required gap between the magnetic gaps G1 and G2 provided in the axial direction are at least about 4 mm, the required thickness of the upper plate 3 is at least 12 mm, thereby creating a limiting factor in making the overall loudspeaker thinner. As a result, when the height of the magnetic circuit of the loudspeaker is limited, a magnet 4 having a reduced thickness must be used, whereby desired features of the loudspeaker are not likely to be obtained due to an insufficient amount of magnetic flux. In addition, because a plurality of screws 9 are needed to securely fix the frame 10 onto the upper plate 3 having a thickness of at least 12 mm, a plurality of screwing operations are required in the assembly process, thereby resulting in inefficiency.

SUMMARY OF THE INVENTION

The present invention has been made in view of the foregoing problems of the related art. Accordingly, it is an object of the present invention to provide a thin magnetic circuit and a thin loudspeaker by providing magnetic gaps at two axially separated positions without applying a complicated machining process on a component serving as a part of the magnetic circuit.

A magnetic circuit according to the present invention comprises an annular magnet magnetized in the axial direction of the magnetic circuit; an annular stacked plate disposed on the magnet and including first and second annular plates; and a yoke opposing the inner circumferential surface of the stacked plate across a cylindrical space. Upper and lower magnetic gaps are provided at two axially separated positions in the cylindrical space. Also, the inner circumferential portions of the first and second annular plates are deformed downward and upward, respectively, in the axial direction such that the inner circumferential surface of the stacked plate opposes the lower and upper magnetic gaps. In addition, the remaining portions of the first and second annular plates, extending outward from the deformed inner circumferential portions in the radial direction of the magnetic circuit, are stacked on the magnet.

A loudspeaker according to the present invention includes a magnetic circuit comprising: an annular magnet magnetized in the axial direction of the magnetic circuit; an annular stacked plate disposed on the magnet and including first and second annular plates; and a yoke opposing the inner circumferential surface of the stacked plate across a cylindrical space. Upper and lower magnetic gaps are provided at two axially separated positions in the cylindrical space. The loudspeaker further comprises a voice coil placed in the upper and lower magnetic gaps; a diaphragm connected to the voice coil; and a frame fixed to the stacked plate and supporting the diaphragm in a vibratable manner. The inner circumferential portions of the first and second annular plates are deformed downward and upward, respectively, in the axial direction such that the inner circumferential surface of the stacked plate opposes the lower and upper magnetic gaps. Also, the remaining portions of the first and second annular plates, extending outward from the deformed inner circumferential portions in the radial direction of the magnetic circuit, are stacked on the magnet.

In the magnetic circuit and the loudspeaker having the above-described structures, since the lower and upper magnetic gaps are formed at respectively predetermined positions simply by disposing the first and second annular plates on the magnet in a stacked manner and the annular plates require no complicated machining process, the linear amplitude regions of the voice coil and the diaphragm can be widened at low cost. Preferably, the inner circumferential portions of the first and second annular plates are deformed by pressing them by a predetermined amount in a predetermined direction. Also, in this magnetic circuit, by stacking these annular plates such that the inner circumferential portions of the annular plates oppose each other in an upside-down opposing manner, a predetermined axial gap is obtained between these inner circumferential portions, i.e., between the magnetic gaps. Accordingly, portions of the annular plates, which radially extend from the inner circumferential portions and which are stacked on the magnet, have a thickness equivalent to that of the two annular plates which are stacked together without leaving a clearance therebetween. As a result, the entire magnetic circuit and the loudspeaker can be made thinner, or their operational features can be improved by making the magnet thicker.

Also, with the above structure, the first and second annular plates can be standardized as a common component and assembled in the magnetic circuit in a mutually upside-down stacking manner. This results in no increase in the number of component types, provides easy component control, and reduces the component cost.

DESCRIPTION OF THE PREFERRED EMBODIMENTS

Figure 1:
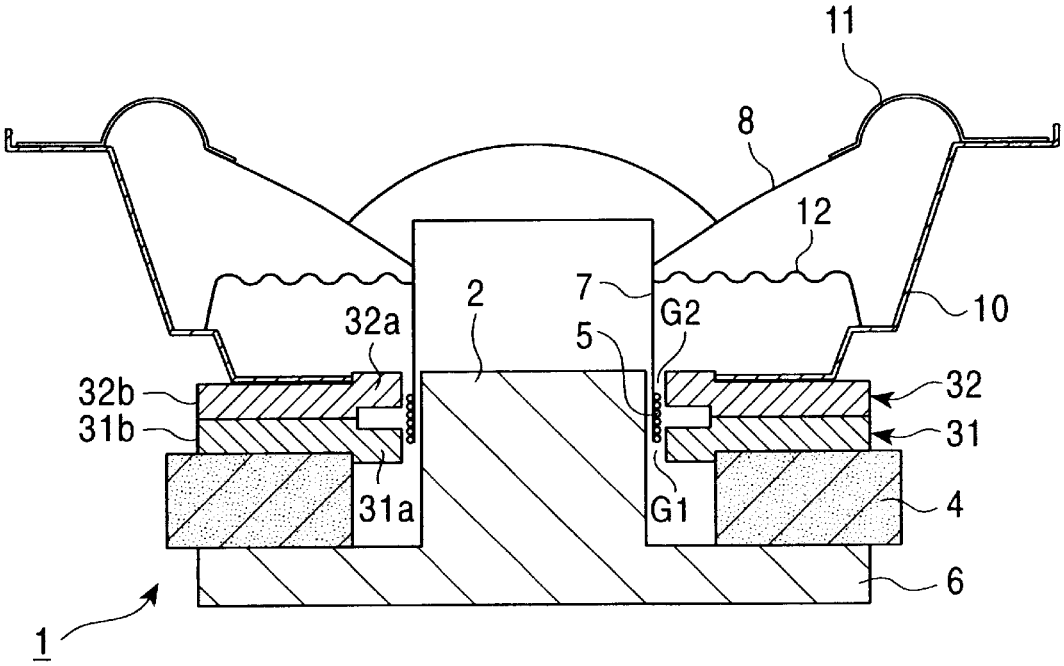
FIG. 1 is a sectional view of a loudspeaker according to a first embodiment of the present invention.

Preferred embodiments of the present invention will be described with reference to the accompanying drawings. Like parts in the drawings are identified by the same reference numerals.

In a magnetic circuit of the loudspeaker shown in FIG. 1, a stacked plate disposed on an annular magnet 4 is formed by first and second annular plates 31 and 32, each having an inner circumferential portion deformed in the axial direction of the magnetic circuit, and the inner circumferential surfaces of these first and second annular plates 31 and 32 face lower and upper magnetic gaps G1 and G2, respectively. The annular plates 31 and 32 can be formed by punching out a magnetic plate, such as an iron plate, so as to have a ring shape and are processed so as to have inner circumferential portions 31*a* and 32*a*, respectively, having substantially the same thicknesses as the remaining portions of the corresponding annular plates 31 and 32 and being axially displaced with respect to each other.

The inner circumferential portion 31*a* of the first annular plate 31 is deformed downward in the axial direction and encircles the lower magnetic gap G1. The first annular plate 31 also has a flat portion 31*b* which is placed on and fixed to the magnet 4 and which extends outward from the inner circumferential portion 31*a* in the radial direction of the magnetic circuit. Because the lower surface of the inner circumferential portion 31*a* of the first annular plate 31 lies below the upper surface of the magnet 4, the radial alignment between the magnet 4 and first annular plate 31 at assembly can be easily and accurately performed by engaging the outer edge of the inner circumferential portion 31*a* with the inner circumferential edge of the magnet 4.

The inner circumferential portion 32*a* of the second annular plate 32 is deformed upward in the axial direction and encircles the upper magnetic gap G2. The second annular plate 32 also has a flat portion 32*b* which is placed on and bonded to the flat portion 31*b* of the first annular plate 31 without leaving a clearance between the flat portions 31*b* and 32*b* and which extends outward from the inner circumferential portion 32*a* in the radial direction. The first and second annular plates 31 and 32 are assembled in the magnetic circuit, upside down from each other, using a common component. Accordingly, because the inner circumferential part of an annular magnetic plate can be deformed in the axial direction by a predetermined amount by pressing, the inner circumferential portions 31*a* and 32*a* are relatively easily formed so as to have substantially the same thicknesses with the corresponding flat portions 31*b* and 32*b* and to have steps. When the first and second annular plates 31 and 32 are stacked as shown in FIG. 1, the inner circumferential portions 31*a* and 32*a*, i.e., the lower and upper magnetic gaps G1 and G2, have a predetermined gap therebetween in the axial direction.

In the foregoing magnetic circuit, since the annular magnet 4 is magnetized in the axial direction so as to have, for example, an N-pole on its upper surface and an S-pole on its lower surface, part of the magnetic flux supplied from the magnet 4 to the first and second annular plates 31 and 32 flows into the inner circumferential portion 31*a*, passes through the lower magnetic gap G1, and flows into a pole piece 2 of a yoke 1, and the remaining part of the magnetic flux flows into the inner circumferential portion 32*a*, passes through the upper magnetic gap G2, and flows into the pole piece 2. Then, the magnetic flux flows down in the pole piece 2, passes through a bottom plate 6 of the yoke 1 made from a magnetic material such as iron, and returns to the magnet 4, thus forming a closed magnetic path. That is, the magnetic circuit is formed by the yoke 1, including the pole piece 2 and the bottom plate 6, the first and second annular plates 31 and 32, and the magnet 4.

The remaining structure of the loudspeaker shown in FIG. 1 will now be described. A voice coil 5 wound around a cylindrical bobbin 7 is vertically disposed so as to extend into the magnetic gaps G1 and G2 such that, with respect to the axial direction, the bottom of the voice coil 5 lies substantially in the upper half of the lower magnetic gap G1 and the top of the voice coil 5 lies substantially in the lower half of the upper magnetic gap G2 when no current is fed. The top of the bobbin 7 in the figure is bonded, with an adhesive, to the inner circumference of a conical diaphragm 8 made from cone paper or the like. A frame 10 is formed from a thin steel plate or the like so as to have an approximate conical shape. The frame 10 supports the outer circumference of the diaphragm 8 at its outer edge portion through an elastic edge 11 in a vibratable manner, and also supports the bobbin 7 through a damper 12 in a vibratable manner. This frame 10 has a fixing structure in which, when the frame 10 is fixed onto the flat portion 32*b* of the second annular plate 32, the frame 10 is radially aligned on the flat portion 32*b* by engaging the inner edge of the frame 10 with the outer edge of the inner circumferential portion 32*a* of the second annular plate 32, and then the inner edge of the frame 10 is fixed onto the second annular plate 32 by squeezing the outer edge of the inner circumferential portion 32*a*, instead of using screws as in the known loudspeaker shown in FIG. 4. As a result, a complicated screwing operation for fixing the frame 10 onto the second annular plate 32 can be eliminated.

Figure 4:
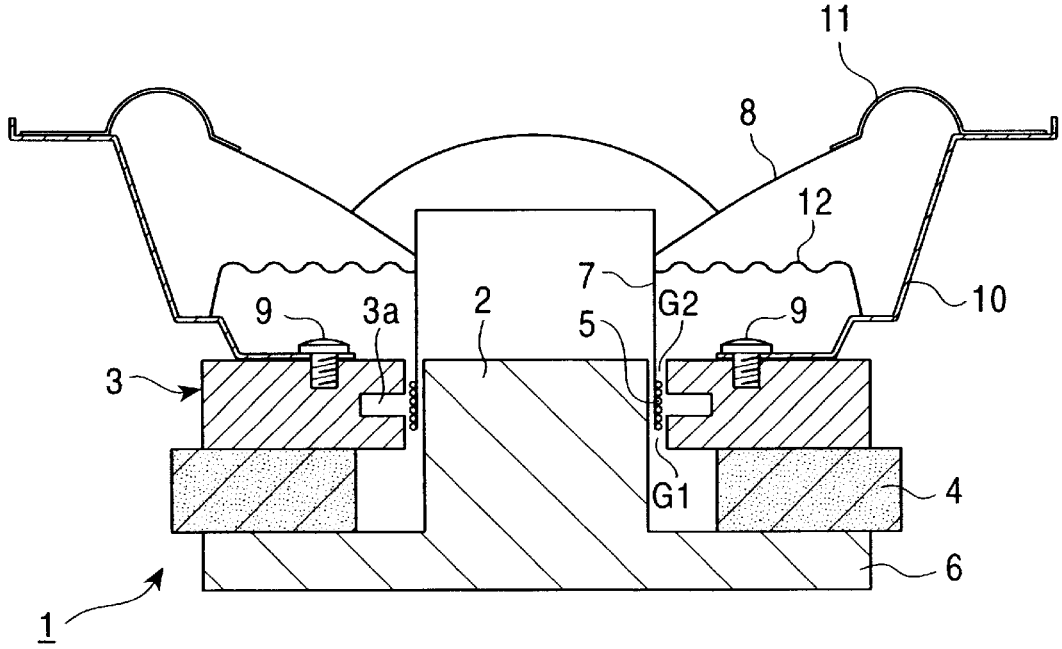
FIG. 4 PRIOR ART
FIG. 4 is a sectional view of a known loud speaker.

As described above, since the loudspeaker according to the first embodiment has a structure in which the lower and upper magnetic gaps G1 and G2, where the voice coil 5 is disposed, are formed in predetermined positions in the axial direction by disposing the first and second annular plates 31 and 32 on the magnet 4 in a stacked manner, the annular plates 31 and 32 do not require a complicated machining process, thereby drastically reducing the machining cost compared to that of the known loudspeaker shown in FIG. 4. Also, since the annular plates 31 and 32 are assembled in the magnetic circuit, upside down from each other, using a common type of component, these plates are easily controlled as a common component and thus reduce their component cost. In addition, the frame 10 can be fixed onto the second annular plate 32 not with screws but by a pressure fit, thereby reducing the assembly cost of the loudspeaker. As a result, even though the loudspeaker according to the first embodiment has a two-gap, one-voice-coil structure so as to widen the linear amplitude regions of the voice coil 5 and the diaphragm 8, the loudspeaker can be manufactured at low cost.

Also, in the magnetic circuit of the loudspeaker according to the first embodiment, the stacked plate of the first and second annular plates 31 and 32 has a predetermined thickness, at the side of the inner circumferential portions 31*a* and 32*a*, which does not limit the linear amplitude region of the voice coil 5, and has another thickness, at the side of the flat portions 31*b* and 32*b* stacked on the thin magnet 4, which is thinner by an amount of the gap formed between the inner circumferential portions 31*a* and 32*a*, thereby easily making the entire magnetic circuit thinner. When a thin magnetic circuit is not required, the features of the loudspeaker can be improved by making the magnet 4 thicker. Also, the lower surface of the inner circumferential portion 31*a* of the first annular plate 31 lies below the upper surface of the magnet 4, and the upper surface of the inner circumferential portion 32*a* of the second annular plate 32 lies above the lower surface of the inner edge of the frame 10, whereby the thickness of the entire loudspeaker can be reduced.

Figure 2:
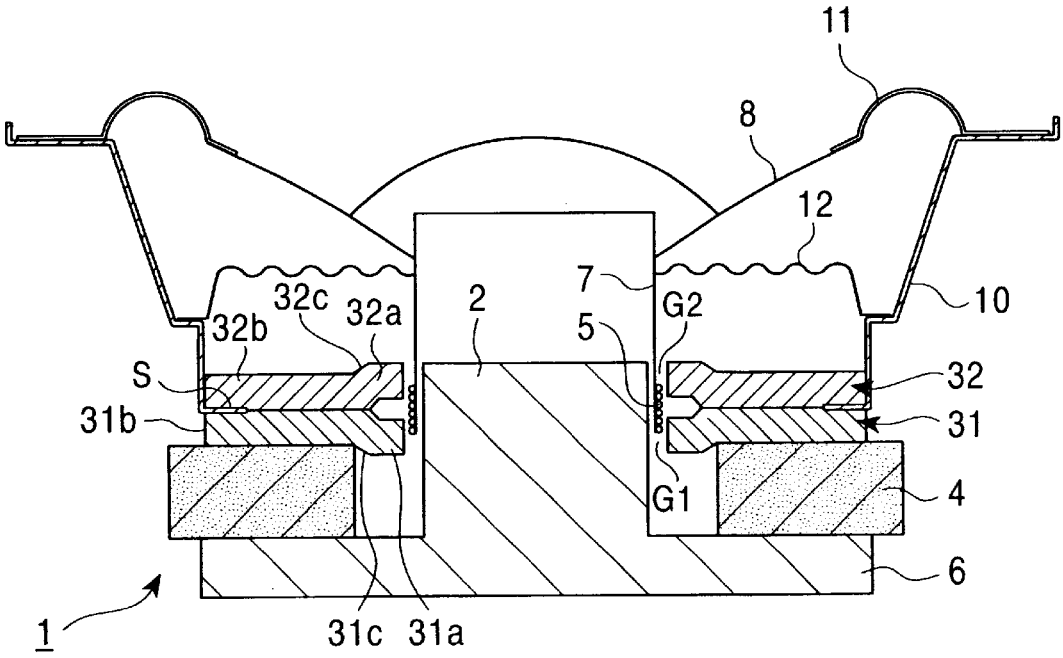
FIG. 2 is a sectional view of a loudspeaker according to a second embodiment of the present invention.
Figure 3:
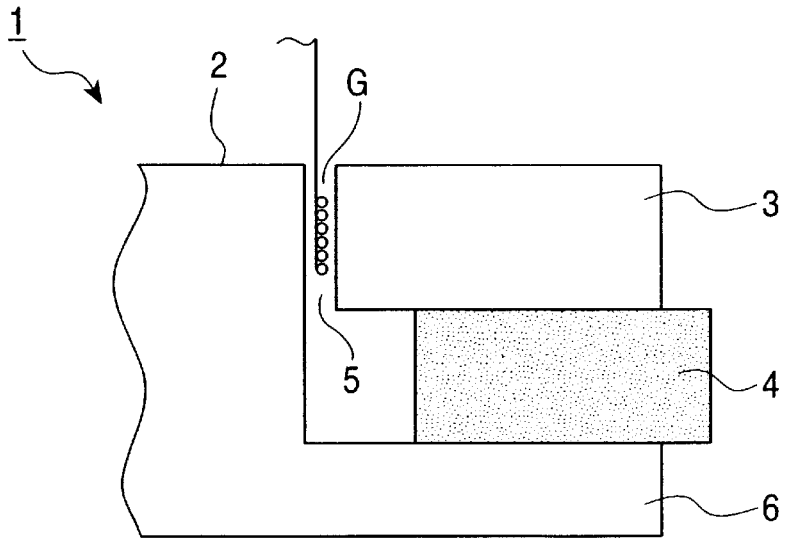
FIG. 3 PRIOR ART
FIG. 3 illustrates a major portion of an example magnetic circuit of a typical loud speaker.

FIG. 2 is a sectional view of a loudspeaker according to a second embodiment of the present invention. Like parts are identified by the same reference numerals of the loudspeaker shown in FIG. 1.

In the loudspeaker according to the second embodiment shown in FIG. 2, slanted portions 31*c* and 32*c* are formed between the inner circumferential portions 31*a* and 32*a* and the flat portions 31*b* and 32*b* of the annular plates 31 and 32, respectively. When the annular plates 31 and 32 are formed as described above, the inner circumferential portions 31*a* and 32*a* are very easily deformed by pressing. In this case, the frame 10 cannot be fixed onto the second annular plate 32 by squeezing the outer edge of the inner circumferential portion 32*a* of the second annular plate 32 as in the foregoing first embodiment to obtain a pressure fit. However; the frame 10 can be fixed to the second annular plate 32 by clamping the inner edge of the frame 10 between the outer circumferential portions of the flat portions 31*b* and 32*b* of the annular plates 31 and 32. For example, when each of the flat portions 31*b* and 32*b* is formed in advance so as to have an indented step of about 0.5 mm in depth at the outer circumferential portion of one surface, because a slit S having an opening width of about 1 mm is formed between the mutually opposing indented steps of the stacked flat portions 31*b* and 32*b*, the frame 10 can be fixed to the stacked plate with an adhesive by inserting its inner edge into the slit S. When the inner edge of the frame 10 is inserted into the slit S, it is placed on the first annular plate 31, and then the second annular plate 32 is stacked on the first annular plate 31 after passing through the inside of the frame 10. As described above, the loudspeaker according to the second embodiment shown in FIG. 2 offers better assembly efficiency than that in which the frame 10 is fixed with screws.

What is claimed is:

1. A magnetic circuit comprising:

an annular magnet magnetized in the axial direction of the magnetic circuit;

an annular stacked plate disposed on the magnet and including first and second annular plates; and a yoke facing the inner circumferential surface of the stacked plate across a cylindrical space, wherein upper and lower magnetic gaps are provided at two axially separated positions in the cylindrical space; the inner circumferential portions of the first and second annular plates are deformed downward and upward, respectively, in the axial direction such that the inner circumferential surface of the stacked plate faces the lower and upper magnetic gaps; and the remaining portions of the first and second annular plates, extending outward from the deformed inner circumferential portions in the radial direction of the magnetic circuit, are stacked on the magnet.

2. The magnetic circuit according to claim 1, wherein the first and second annular plates are assembled in the magnetic circuit, upside down from each other, using a common component.

3. The magnetic circuit according to claim 1, wherein the inner circumferential portions of the first and second annular plates are deformed by pressing.

4. The magnetic circuit according to claim 1, wherein the first and second annular plates have respective flat portions extending outward from the corresponding inner circumferential portions in the radial direction, and the inner circumferential portions and the corresponding flat portions have respective slanted portions therebetween.

5. The magnetic circuit according to claim 1, wherein the lower surface of the inner circumferential portion of the first annular plate lies below the upper surface of the magnet.

6. The magnetic circuit according to claim 5, wherein the outer edge of the inner circumferential portion of the first annular plate is engaged with the inner circumferential edge of the magnet so as to mutually align the first annular plate and the magnet in the radial direction.

7. A loudspeaker comprising:

a magnetic circuit, the magnetic circuit comprising:

an annular magnet magnetized in the axial direction of the magnetic circuit;

an annular stacked plate disposed on the magnet and including first and second annular plates; and a yoke facing the inner circumferential surface of the stacked plate across a cylindrical space, wherein upper and lower magnetic gaps are provided at two axially separated positions in the cylindrical space, the loudspeaker further comprising:

a voice coil placed in the upper and lower magnetic gaps;

a diaphragm connected to the voice coil; and a frame fixed to the stacked plate and supporting the diaphragm in a vibratable manner, wherein the inner circumferential portions of the first and second annular plates are deformed downward and upward, respectively, in the axial direction such that the inner circumferential surface of the stacked plate faces the lower and upper magnetic gaps; and the remaining portions of the first and second annular plates, extending outward from the deformed inner circumferential portions in the radial direction of the magnetic circuit, are stacked on the magnet.

8. The loudspeaker according to claim 7, wherein the first and second annular plates are assembled in the magnetic circuit, upside down from each other, using a common component.

9. The loudspeaker according to claim 7, wherein the inner circumferential portions of the first and second annular plates are deformed by pressing.

10. The loudspeaker according to claim 7, wherein the first and second annular plates have respective flat portions extending outward from the corresponding inner circumferential portions in the radial direction, and the inner circumferential portions and the corresponding flat portions have respective slanted portions therebetween.

11. The loudspeaker according to claim 7, wherein the lower surface of the inner circumferential portion of the first annular plate lies below the upper surface of the magnet.

12. The loudspeaker according to claim 11, wherein the outer edge of the inner circumferential portion of the first annular plate is engaged with the inner circumferential edge of the magnet so as to mutually align the first annular plate and the magnet in the radial direction.

13. The loudspeaker according to claim 7, wherein the diaphragm is conical-shaped; the inner circumference of the diaphragm is connected to the voice coil; the outer circumference of the diaphragm is supported at an outer edge of the frame in a vibratable manner; and a lower surface of an inner edge of the frame lies below the upper surface of the inner circumferential portion of the second annular plate.

14. The loudspeaker according to claim 13, wherein the inner edge of the frame is engaged with the outer edge of the inner circumferential portion of the second annular plate, and the frame and the second annular plate are mutually aligned in the radial direction.

15. The loudspeaker according to claim 14, wherein the inner edge of the frame is fixed, by a pressure fit, to the outer edge of the inner circumferential portion of the second annular plate.

16. The loudspeaker according to claim 7, wherein the diaphragm is conical-shaped; the inner circumference of the diaphragm is connected to the voice coil; the outer circumference of the diaphragm is supported at an outer edge of the frame in a vibratable manner; and an inner edge of the frame is clamped between the outer circumferential portions of the first and second annular plates.

17. The loudspeaker according to claim 16, wherein the outer circumferential portions of the first and second annular plates have respective indented steps on the mutually opposing surfaces thereof so as to form a slit therebetween, and the inner edge of the frame is inserted into the slit.

18. The loudspeaker according to claim 7, wherein, with respect to the axial direction, the bottom of the voice coil lies in the upper half of the lower magnetic gap and the top of the voice coil lies in the lower half of the upper magnetic gap when no current is fed.

* * * * *